US008696404B2

(12) United States Patent
Sun et al.

(10) Patent No.: US 8,696,404 B2
(45) Date of Patent: Apr. 15, 2014

(54) SYSTEMS FOR RECYCLING SLURRY MATERIALS DURING POLISHING PROCESSES

(75) Inventors: Qi Sun, Mountain View, CA (US); David Graves, Tracy, CA (US); John P. Sargent, Tracy, CA (US); Lindsey A. Hamilton, San Jose, CA (US)

(73) Assignee: WD Media, LLC, San Jose, CA (US)

( * ) Notice: Subject to any disclaimer, the term of this patent is extended or adjusted under 35 U.S.C. 154(b) by 217 days.

(21) Appl. No.: 13/333,950

(22) Filed: Dec. 21, 2011

(65) Prior Publication Data

US 2013/0165029 A1 Jun. 27, 2013

(51) Int. Cl.
*B24C 9/00* (2006.01)

(52) U.S. Cl.
USPC ..... 451/2; 451/88; 210/641; 210/651; 210/195.1

(58) Field of Classification Search
USPC ..... 451/2, 3, 87, 88, 285, 287, 447; 210/641, 650, 651, 652, 195.1
See application file for complete search history.

(56) References Cited

U.S. PATENT DOCUMENTS 5,647,989 A * 7/1997 Hayashi et al. ..... 210/641
5,664,990 A * 9/1997 Adams et al. ..... 451/60
5,755,614 A 5/1998 Adams et al.
5,791,970 A 8/1998 Yueh
6,077,437 A * 6/2000 Hayashi et al. ..... 210/651
6,106,728 A 8/2000 Iida et al.
6,126,531 A 10/2000 Iida et al.
6,183,352 B1 2/2001 Kurisawa
6,406,622 B1 * 6/2002 Tsuihiji et al. ..... 210/193
6,413,151 B2 7/2002 Mizuno et al.
6,458,020 B1 10/2002 Brigante et al.
6,475,071 B1 11/2002 Joslyn
6,517,733 B1 * 2/2003 Carlson ..... 210/785
6,527,969 B1 3/2003 Tanoue et al.
6,589,872 B1 7/2003 Twu et al.
6,830,679 B2 12/2004 Tsuihiji et al.
6,866,784 B2 3/2005 Chang et al.
7,014,770 B2 3/2006 Umezawa et al.
7,025,796 B2 4/2006 Komiya et al.
7,052,599 B2 5/2006 Osuda et al.
7,059,943 B2 6/2006 Cann et al.
7,122,475 B2 * 10/2006 Hudson ..... 438/692
7,303,691 B2 12/2007 Kozasa et al.
7,331,844 B2 * 2/2008 Tanoue et al. ..... 451/41
7,625,262 B2 12/2009 Abe et al.
7,820,051 B2 10/2010 Fang et al.
8,202,429 B2 * 6/2012 Abe et al. ..... 210/652
2002/0045349 A1 4/2002 Rhoades
2003/0017703 A1 1/2003 Korthuis
2008/0233724 A1 9/2008 Fang et al.
2009/0053981 A1 2/2009 Kozasa et al.
2010/0270403 A1 10/2010 Gotou
2011/0070811 A1 3/2011 Neuber et al.
2011/0180483 A1 7/2011 Morinaga et al.
2011/0256802 A1 10/2011 Singh et al.
2012/0196442 A1 8/2012 Deng

* cited by examiner

*Primary Examiner* — Eileen P. Morgan

(57) ABSTRACT

Systems for recycling slurry materials during polishing processes are provided. One system includes a polisher having an inlet and drain outlet, and a slurry storage tank to supply a slurry including a preselected material to the polisher inlet, and a recycling assembly including a cross flow filter including an inlet to receive a waste slurry including the preselected material from the polisher drain outlet, where the cross flow filter is configured to concentrate the preselected material in an outlet slurry, a density meter configured to measure a concentration of the preselected material in the filter outlet slurry, a valve coupled to the filter outlet and configured to supply the slurry storage tank, and a controller coupled to the density meter and valve, where the controller is configured to open the valve when the concentration of the preselected material reaches a first concentration threshold.

14 Claims, 2 Drawing Sheets

SYSTEMS FOR RECYCLING SLURRY MATERIALS DURING POLISHING PROCESSES

FIELD

The present invention relates to polishing processes, and more specifically to systems for recycling slurry materials during the polishing processes.

BACKGROUND

Polishing processes are used for many different applications to clean or finish a particular work piece. One such process includes the polishing of disk-shaped substrates to be used for storing information in a storage device. These disk-shaped substrates can be made of magnetic media materials configured to store information when a magnetic transducer writes to the media.

In many polishing systems, valuable slurry materials are simply lost in drainage. In other polishing systems, slurry recycling is used. However, conventional polishing systems incorporating slurry recycling are either ineffective or cost prohibitive. In addition, conventional polishing systems may not be designed to recycle particular materials. As such, an improved system for recycling slurry materials during polishing processes is needed.

SUMMARY

Aspects of the invention relate to systems for recycling slurry materials during polishing processes. In one embodiment, the invention relates to a system for recycling a preselected slurry material from a polishing assembly, the system including the polishing assembly including a polisher having an inlet and a drain outlet, and a slurry recycle tank configured to supply a slurry including a preselected material to the inlet of the polisher, and a recycling assembly including a cross flow filter including an inlet configured to receive a waste slurry including the preselected material from the drain outlet of the polisher, where the cross flow filter is configured to concentrate the preselected material in a slurry provided at an outlet of the cross flow filter, a density meter configured to measure a concentration of the preselected material in the outlet slurry of the cross flow filter, a valve coupled to the outlet of the cross flow filter and configured to supply the slurry storage tank, and a controller coupled to the density meter and the valve, where the controller is configured to open the valve when the concentration of the preselected material reaches a first preselected concentration threshold.

DETAILED DESCRIPTION

Figure 1:
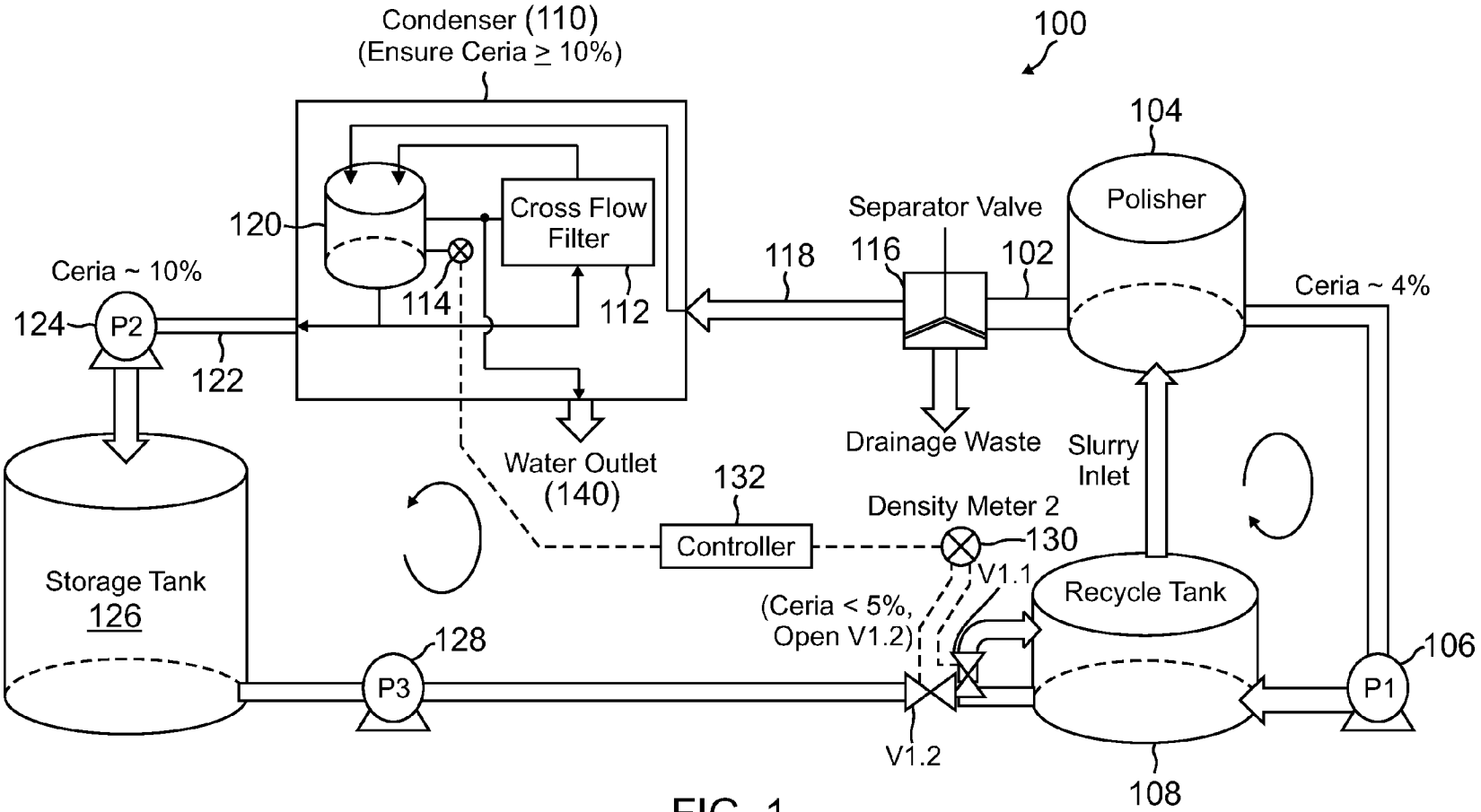
FIG. 1 is a schematic diagram of a system for recycling ceria from a rinse water product of a polishing assembly, the system including a condenser having a cross flow filter and a first density meter for ensuring a preselected concentration of ceria is accumulated in the recycled slurry before it is returned to the polishing assembly in accordance with one embodiment of the invention.

Referring now to the drawings, embodiments of systems for recycling preselected slurry materials from a polishing assembly are illustrated. The recycling systems include a cross flow filter configured to receive a waste slurry including a preselected material from the polishing assembly. The cross flow filter is further configured to concentrate the preselected material from the waste slurry. The recycling systems further include a first density meter configured to measure the concentration of the preselected material and a controller to ensure that the concentration reaches a preselected threshold before it is returned to the polishing assembly. The controller is coupled to one or more valves and possibly one or more pumps for controlling the flow of slurry in the recycling system. In one embodiment, the preselected threshold is about 10 percent. In other embodiments, the preselected threshold can be more than or less than 10 percent.

In several embodiments, the recycling system includes a second density meter coupled to the controller and a recycle tank of the polishing assembly. In such case, the second density meter is configured to monitor the concentration of the preselected material in the polishing assembly. When the preselected material concentration drops below a second preselected threshold, the controller can allow the slurry with concentrated preselected material from the recycling system to fill the recycle tank. In this way, the recycling systems can efficiently collect and recycle the preselected material from a polishing assembly. In several embodiments, the preselected material includes ceria or another rare earth oxide type material. In one such embodiment, the recycling systems can collect up to about 100 percent of the ceria in the waste slurry from the polishing assembly.

FIG. 1 is a schematic diagram of a system 100 for recycling ceria from a rinse water product 102 of a polishing assembly (104, 106, 108), the system 100 including a condenser 110 having a cross flow filter 112 and a first density meter 114 for ensuring a preselected concentration of ceria is accumulated in the recycled slurry before it is returned to the polishing assembly (104, 106, 108) in accordance with one embodiment of the invention. For the operation of the polishing assembly (104, 106, 108), the polisher 104 receives a polishing slurry from a recycle tank 108 and recycles a portion of the polishing slurry via pump P1 or 106 to the recycle tank 108 with a ceria concentration of about 4 percent. The polisher 104 also outlets a waste portion (e.g., rinse water product) 102 of the polishing slurry to a separator valve 116.

For the operation of the recycling assembly portion of the system 100 (e.g., those components of the system 100 that are not part of the polishing assembly (104, 106, 108)), the separator valve 116 can work on timing to remove some of the waste slurry 102 that is particularly low in ceria concentration, while the remainder (e.g., separator valve slurry) 118 is provided to the condenser 110. In one embodiment, slurry having a preselected ceria concentration of about 0.5 percent or less is removed by the separator valve 116.

The condenser 110 is configured to concentrate the ceria to a preselected concentration threshold of about 10 percent in a condenser slurry 122 using the cross flow filter 112 and the first density meter 114, and to store the concentrated condenser slurry in a condenser storage tank 120. The condenser slurry 122 is then pumped by pump 124 or P2 and stored in a main slurry storage tank 126. The condenser slurry with the concentrated ceria of about 10 percent is then pumped by pump 128 or P3 to the recycle tank 108 of the polishing assembly.

A second density meter 130 monitors the concentration of ceria in the recycle tank 108 and together with a controller 132 controls valve V1.1 and valve V1.2 to ensure that when the ceria is below a second preselected concentration threshold of about 5 percent, the concentrated condenser slurry from storage tank 126 is pumped into the recycle tank 108. More specifically, when the ceria concentration in the recycle tank 108 is less than about 5 percent, the controller 132 closes V1.1 and opens V1.2 to allow the concentrated slurry into the recycle tank 108. The controller 132 is also coupled to the first density meter 114 and can control the condenser 110 operation as discussed in greater detail below. In several embodiments, the controller 132 is also coupled to some or all of the pumps to facilitate the ceria recycling.

In the recycling system illustrated in FIG. 1, particular preselected concentration thresholds are used. In other embodiments, other preselected concentration thresholds can be used. In the recycling system illustrated in FIG. 1, ceria is the material being recycled. In other embodiments, other preselected rare earth oxides can be recycled using the recycling system. In the recycling system illustrated in FIG. 1, a preselected number of pumps and valves are used to control the flow of slurry throughout the system. In other embodiments, fewer pumps and valves can be used. In other embodiments, more pumps and valves can be used to control the flow of slurry in the system.

The controller 132 can include one or more processing components that share information (e.g., processors, microprocessors, programmable logic devices, and/or other processing circuitry). In several embodiments, these processing components can include one or more volatile or non-volatile memory components that store information accessible to the processing components and/or other system components.

Figure 2:
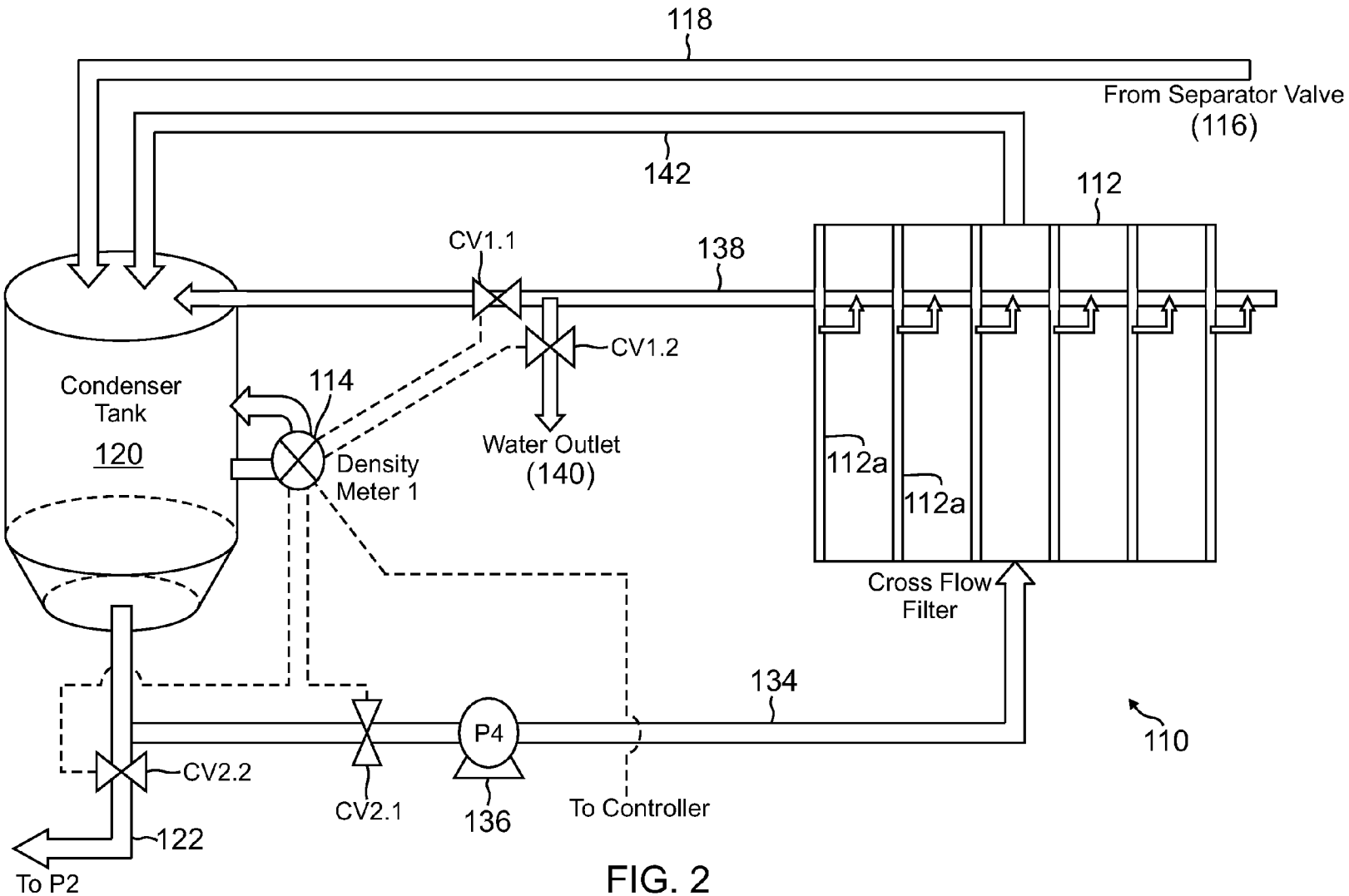
FIG. 2 is a detailed schematic diagram of the condenser of FIG. 1 including the cross flow filter for concentrating the ceria in a condenser outlet slurry and the first density meter for releasing the concentrated outlet slurry once the preselected ceria concentration threshold has been reached in accordance with one embodiment of the invention.

FIG. 2 is a detailed schematic diagram of the condenser 110 of FIG. 1 including the cross flow filter 112 for concentrating the ceria in a condenser outlet slurry 122 and the first density meter 114 for releasing the concentrated outlet slurry 122 once the preselected ceria concentration threshold has been reached in accordance with one embodiment of the invention. The condenser 110 receives the separator valve slurry 118 and directs it into the condenser storage tank 120. The first density meter 114 can determine whether the ceria concentration of the slurry within the condenser storage tank 120 is at least about 10 percent. If so, the controller 132 (not visible in FIG. 2 but see FIG. 1) and/or first density meter 114 can close condenser valve 2.1 or CV2.1 and open condenser valve 2.2 or CV2.2. In such case, the concentrated slurry 122 is made available to pump P2. If the ceria concentration of the slurry within the condenser storage tank 120 is not at least about 10 percent, then CV2.2 remains closed and CV2.1 is kept open. In such case, the under concentrated slurry 134 is pumped by pump P4 or 136 into the cross flow filter 112.

The cross flow filter 112 includes six membranes 112*a* which consist of long tubes having permeate filter screens positioned along the side walls of the tubes allowing less concentrated slurry 138 (e.g., solution including a high concentration of water) to exit the cross flow filter 112 laterally and via condenser valve 1.2 or CV1.2 to a water outlet 140. The filter screens have multiple openings that are sized to allow smaller molecular particles, such as water, to exit laterally. The typical ceria molecular particle is however too large to enter the filter openings, and, as such, remains in the outlet stream of the filter providing a concentrated slurry 142 to the condenser tank 120. In several embodiments, a cross stream of fluid such as water may be applied in the lateral direction (e.g., lateral to the direction of the membrane long tubes 112*a*) to help facilitate the separation of the low ceria concentration slurry (e.g., primarily water) from the higher concentration slurry moving along the tube direction. In this way, the cross flow filter 112 and first density meter 114 can work together to continually increase the concentration of ceria in the condenser slurry 122 stored in the condenser tank 120.

In some cases, it can be desirable to keep the water solution 138 in the condenser 100 rather than purging it via the water outlet 140, such as when a desirable concentration of ceria has been achieved. In such case, the controller 132 and/or first density meter 114 can close CV1.2 and open CV1.1, and as a result the water solution 138 is sent back into the condenser tank 120.

In one embodiment, the cross flow filter 112 is an ultra-filter that is configured to allow only material less than a certain preselected particle size through the filter. In such case, the ultra-filter can operate in a manner similar to a reverse osmosis or other such filter. In one embodiment, the preselected particle size for the cross flow filter 112 is about 0.01 microns. In some embodiments, other suitable cross flow filters known in the art may be used. In one embodiment, the cross flow filter is a multi-stage stage membrane filter. In the embodiment illustrated in FIG. 2, the cross flow filter 112 consists of six membranes. In other embodiments, the cross flow filter 112 can have more than, or less than, six membranes.

In one embodiment, the first density meter 114 is a very accurate instrument that uses a U-shaped tube and measures the resonant frequency of vibration of the liquid passing through the U-shaped tube to determine density. In other embodiments, other density meters having relatively high accuracy can be used.

While the above description contains many specific embodiments of the invention, these should not be construed as limitations on the scope of the invention, but rather as examples of specific embodiments thereof. Accordingly, the scope of the invention should be determined not by the embodiments illustrated, but by the appended claims and their equivalents.

What is claimed is:

1. A system for recycling a preselected slurry material from a polishing assembly, the system comprising:

the polishing assembly comprising:

a polisher having an inlet and a drain outlet; and a slurry storage tank configured to supply a slurry comprising a preselected material to the inlet of the polisher; and a recycling assembly comprising:

a cross flow filter comprising an inlet configured to receive a waste slurry comprising the preselected material from the drain outlet of the polisher, wherein the cross flow filter is configured to concentrate the preselected material in a slurry provided at an outlet of the cross flow filter;

a density meter configured to measure a concentration of the preselected material in the outlet slurry of the cross flow filter;

a valve coupled to the outlet of the cross flow filter and configured to supply the slurry storage tank; and a controller coupled to the density meter and the valve, wherein the controller is configured to open the valve when the concentration of the preselected material reaches a first preselected concentration threshold, wherein the density meter is configured to measure a resonant frequency of the outlet slurry from the cross flow filter.

2. The system of claim 1, wherein the density meter is configured to measure the resonant frequency of the outlet slurry from the cross flow filter in a U-shaped tube.

3. The system of claim 1, further comprising:

a first pump configured to receive the outlet slurry of the cross flow filter;

a concentrate storage tank coupled to the first pump and configured to store the outlet slurry of the cross flow filter;

a second pump coupled to the concentrate storage tank;

a second valve coupled between the pump and the slurry storage tank;

a second density meter configured to measure a concentration of the preselected material in the slurry storage tank;

wherein the controller is configured to open the second valve when the concentration of the preselected material measured by the second density meter is below a second preselected concentration threshold.

4. The system of claim 3, wherein the second preselected concentration threshold is about 5 percent, and wherein the first preselected concentration threshold is about 10 percent.

5. The system of claim 1, wherein the first preselected concentration threshold is about 10 percent.

6. The system of claim 1, wherein the preselected material comprises a preselected rare earth oxide.

7. The system of claim 6, wherein the preselected rare earth oxide comprises ceria.

8. The system of claim 1, further comprising a separator valve positioned between the polisher and the cross flow filter, wherein the separator valve is configured to eliminate a portion of the waste slurry having a concentration of the preselected material below a third preselected threshold.

9. The system of claim 1, wherein the polishing assembly further comprises a pump coupled to the polisher and configured to direct a portion of the slurry from the polisher to the slurry storage tank.

10. The system of claim 1, wherein the cross flow filter comprises a plurality of membranes.

11. The system of claim 10, wherein the plurality of membranes each comprise an elongated tubular shape.

12. The system of claim 11, wherein the plurality of membranes each comprise an opening along a side wall of the elongated tubular shape.

13. The system of claim 12:

wherein a first slurry is configured to exit ends of the elongated tubular shaped membranes;

wherein a second slurry is configured to exit the side walls of the elongated tubular shaped membranes;

wherein a concentration of the preselected material in the first slurry is greater than a concentration of the preselected material in the second slurry.

14. The system of claim 12, wherein a size of a particle of the preselected material is greater than a size of the opening.

* * * * *